US009601835B2

(12) United States Patent
Liu et al.

(10) Patent No.: US 9,601,835 B2
(45) Date of Patent: Mar. 21, 2017

(54) OFFSET FEED SATELLITE TELEVISION ANTENNA AND SATELLITE TELEVISION RECEIVER SYSTEM THEREOF

(75) Inventors: Ruopeng Liu, Shenzhen (CN); Chunlin Ji, Shenzhen (CN); Yutao Yue, Shenzhen (CN); Jinjin Wang, Shenzhen (CN); Yunnan Hong, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 430 days.

(21) Appl. No.: 14/235,059

(22) PCT Filed: Nov. 18, 2011

(86) PCT No.: PCT/CN2011/082423

§ 371 (c)(1),
(2), (4) Date: May 24, 2014

(87) PCT Pub. No.: WO2013/013456

PCT Pub. Date: Jan. 31, 2013

(65) Prior Publication Data

US 2014/0320360 A1 Oct. 30, 2014

(30) Foreign Application Priority Data

Jul. 26, 2011 (CN) ..... 2011 1 0210203
Jul. 26, 2011 (CN) ..... 2011 1 0210346
(Continued)

(51) Int. Cl.
*H01Q 19/10* (2006.01)
*H01Q 19/06* (2006.01)
(Continued)

(52) U.S. Cl.
CPC ..... *H01Q 19/06* (2013.01); *H01Q 15/0086* (2013.01); *H01Q 15/02* (2013.01);
(Continued)

(58) Field of Classification Search
USPC ..... 359/642, 620, 321, 341.32, 586, 652; 250/339.05, 482.1, 503.1; 375/338;
(Continued)

(56) References Cited

U.S. PATENT DOCUMENTS

2010/0067091 A1* 3/2010 Smith ..... B82Y 20/00 359/278

FOREIGN PATENT DOCUMENTS

CN 101699659 A 4/2010
CN 201515017 A 6/2010
(Continued)

*Primary Examiner* — Jae Kim
(74) *Attorney, Agent, or Firm* — Perkins Coie LLP

(57) ABSTRACT

Disclosed is an offset feed satellite television antenna comprising a metamaterial panel (100) arranged behind a feed (1). The metamaterial panel (100) comprises a core layer (10) and a reflective panel (200) arranged on a lateral surface of the core layer (10). The core layer (10) comprises at least one core layer lamella (11). The core layer lamella (11) can be divided into multiple belt areas on the basis of refractive indexes. With a fixed point as a center, the refractive indexes on the multiple belt areas are identical at a same radius, while the refractive indexes on each belt area decrease gradually as the radius increases. For two adjacent belt areas, the minimum value of the refractive indexes of the inner belt area is less than the maximum value of the refractive indexes of the outer belt area. A connection between the center and the feed (1) is perpendicular to the core layer lamella (11), while the center does not overlap the center of the core layer lamella (11). In addition, the present invention also provides a satellite television receiver system having the offset feed satellite television antenna. The pres-
(Continued)

ent invention allows for facilitated manufacturing and processing, and for further reduced costs.

13 Claims, 13 Drawing Sheets

(30) Foreign Application Priority Data

Aug. 23, 2011 (CN) ..... 2011 1 0242602
Aug. 23, 2011 (CN) ..... 2011 1 0242703

(51) Int. Cl.
*H01Q 15/00* (2006.01)
*H01Q 15/02* (2006.01)
*H01Q 15/10* (2006.01)
*H01Q 15/23* (2006.01)

(52) U.S. Cl.
CPC ..... *H01Q 15/10* (2013.01); *H01Q 15/23* (2013.01); *H01Q 19/065* (2013.01); *H01Q 19/10* (2013.01)

(58) Field of Classification Search
USPC ..... 343/753, 909, 757, 761, 782
See application file for complete search history.

(56) References Cited

FOREIGN PATENT DOCUMENTS

| | | | |
|---|---|---|---|
| CN | 101867094 | A | 10/2010 |
| FR | 2538959 | A1 | 7/1984 |
| TW | 200743264 | A | 11/2007 |

* cited by examiner

OFFSET FEED SATELLITE TELEVISION ANTENNA AND SATELLITE TELEVISION RECEIVER SYSTEM THEREOF

FIELD OF THE INVENTION

The present invention relates to the communications field, and in particular, to an offset feed satellite television antenna and a satellite television receiving system thereof.

BACKGROUND OF THE INVENTION

A traditional satellite television receiving system is a satellite ground receiving station formed of a paraboloidal antenna, a feed, a low noise block, and a satellite receiver. The paraboloidal antenna is responsible for reflecting a satellite signal into the feed and the low noise block located at a focus. The feed is a horn that is set at the focus of the paraboloidal antenna and used to collect satellite signals, and is also called a corrugated horn. It has two main functions: One function is to collect electromagnetic wave signals received by the antenna, convert the signals into signal voltage, and feed the signal voltage to the low noise block; and the other function is to perform polarization conversion for received electromagnetic waves. The low noise block LNB (also called a noise frequency alias demultiplier) demultiplies a noise frequency of the satellite signal fed by the feed, amplifies the signal, and then transmits the signal to a satellite receiver. LNBs are generally categorized into C-band LNBs (3.7 GHz-4.2 GHz, 18-21 V) and Ku-band LNBs (10.7 GHz-12.75 GHz, 12-14V). A working procedure of the LNB is to amplify a satellite high-frequency signal until it is multiplied by hundreds of thousands, and then convert the high-frequency signal into an intermediate frequency 950 MHz-2050 MHz by using a local oscillation circuit, which facilitates transmission over a coax cable and demodulation and working of the satellite receiver. The satellite receiver demodulates the satellite signal transmitted by the low noise block to generate a satellite television image or a digital signal and a sound signal.

When the satellite signal is received, parallel electromagnetic waves converge onto the feed after being reflected by the paraboloidal antenna. The feed corresponding to the paraboloidal antenna is generally a horn antenna.

However, a reflecting curved surface of the paraboloidal antenna is difficult to process and is precision-demanding, and therefore, the manufacturing is troublesome and costs are high.

SUMMARY OF THE INVENTION

A technical issue to be solved by the present invention is to provide an offset feed satellite television antenna characterized by easy processing and low manufacturing costs to overcome defects of difficult processing and high costs of the satellite antenna in the prior art.

A technical solution used to solve the technical issue of the present invention is: an offset feed satellite television antenna, where the offset feed satellite television antenna includes a metamaterial panel that is set behind a feed, where the metamaterial panel includes a core layer and a reflective panel that is set on a surface on a side of the core layer, the core layer includes at least one core layer sheet layer, the core layer sheet layer includes a sheet-shaped substrate and a plurality of artificial microstructures or pore structures that are set on the substrate, the core layer sheet layer is divisible into a plurality of strip regions according to refractive index profile, refractive indexes at a same radius that uses a specific point as a circle center in the a plurality of strip regions are the same and the refractive index decreases gradually with increase of the radius in each strip region, and, among two adjacent strip regions, a minimum value of the refractive index of a strip region located at an inner side is less than a maximum value of the refractive index of a strip region located at an outer side, a line that connects the circle center and the feed is vertical to the core layer sheet layer, and the circle center does not coincide with a center of the core layer sheet layer.

Further, the core layer sheet layer further includes a filler layer that covers the artificial microstructures.

Further, the core layer includes a plurality of core layer sheet layers that are parallel to each other.

Further, all strip regions of a core layer sheet layer close to the reflective panel among the a plurality of core layer sheet layers have a same refractive index range, that is, refractive indexes of each strip region decrease from a maximum value $n_{max}$ to a minimum value $n_{min}$ continuously.

Refractive index profile of a core layer sheet layer close to the reflective panel among the a plurality of core layer sheet layers satisfies the following formulas:

$$n(r)_m = n_{max} - \frac{\sqrt{r^2+s^2} - \sqrt{(M_L + seg_k)^2 + s^2}}{d};$$

$$seg_k = \sqrt{(v_0 + k\lambda)^2 - s^2} - \sqrt{v_o^2 - s^2};$$

$$k = \text{floor}\left(\frac{\sqrt{\left(|r - M_L| + \sqrt{v_o^2 - s^2}\right)^2 + s^2} - v_0}{\lambda}\right);$$

and $$v_o = \sqrt{M_L^2 + s^2},$$

where, $n(r)_m$ represents a refractive index value at a radius of r on the core layer sheet layer, and m represents a serial number of the core layer sheet layer and the total number of the core layer sheet layers;

s is a vertical distance from the feed to a core layer sheet layer close to the feed; and d is thickness of the core layer.

Further, refractive index profile of other core layer sheet layers satisfies the following formula:

$$n(r)_j = n_{min} + \frac{j}{m}(n(r)_m - n_{min}),$$

where, j represents a serial number of the core layer sheet layer, the serial number of the core layer sheet layer close to the reflective panel is m, the serial number decreases consecutively in a direction from the reflective panel to the feed, and the serial number of the core layer sheet layer close to the feed is 1.

Further, the core layer is formed of 7 core layer sheet layers, that is, m=7.

Further, the circle center is set in a location that is $M_L$ away from a lower edge of the core layer sheet layer.

Further, the lower edge is a straight line, and the $M_L$ represents a distance between the circle center and a midpoint of the lower edge.

Further, the lower edge is a curve, and the $M_L$ represents a distance between the circle center and a vertex of the lower edge.

Further, a plurality of artificial microstructures of each core layer sheet layer of the core layer have a same shape, a plurality of artificial microstructures at the same radius have same geometric dimensions, the geometric dimensions of the artificial microstructures decrease gradually with increase of the radius in each strip region, and, among two adjacent strip regions, a minimum value of the geometric dimensions of the artificial microstructure of a strip region located at an inner side is less than a maximum value of the geometric dimensions of the artificial microstructure of a strip region located at an outer side.

Further, a plurality of artificial pore structures of each core layer sheet layer of the core layer have a same shape, the a plurality of artificial pore structures are filled with a medium whose refractive index is greater than that of the substrate, a plurality of artificial pore structures at a same radius in a circular region and an annular region have a same size, and, within the circular region and the annular region respectively, the size of the artificial pore structures decreases gradually with increase of the radius, the size of an artificial pore structure of a minimum size in the circular region is less than the size of an artificial pore structure of a maximum size in the annular region adjacent to the circular region, and, among two adjacent annular regions, the size of the artificial pore structure of the minimum size in an annular region located on an inner side is less than the size of the artificial pore structure of the maximum size in an annular region located on an outer side.

Further, a plurality of artificial pore structures of each core layer sheet layer of the core layer have a same shape, the a plurality of artificial pore structures are filled with a medium whose refractive index is less than that of the substrate, a plurality of artificial pore structures at a same radius in a circular region and an annular region have a same size, and, within the circular region and the annular region respectively, the size of the artificial pore structures increases gradually with increase of the radius, the size of an artificial pore structure of a maximum size in the circular region is greater than the size of an artificial pore structure of a minimum size in the annular region adjacent to the circular region, and, among two adjacent annular regions, the size of the artificial pore structure of the maximum size in an annular region located on an inner side is greater than the size of the artificial pore structure of the minimum size in an annular region located on an outer side.

Further, a diverging component that is set behind the feed and has an electromagnetic wave divergence function is included, where the metamaterial panel is set behind the diverging component, the diverging component is a concave lens or a diverging metamaterial panel, the diverging metamaterial panel includes at least one diverging sheet layer, and refractive indexes of the diverging sheet layer are distributed in a circular shape using a center of the diverging sheet layer as a circle center, and, at the same radius, the refractive index is the same, and the refractive index decreases gradually with increase of the radius.

According to the offset feed satellite television antenna of the present invention, the sheet-shaped metamaterial panel replaces a traditional paraboloidal antenna, manufacturing and processing are easier, and costs are lower.

The present invention further provides a satellite television receiving system, including a feed, a low noise block, and a satellite receiver, where the satellite television receiving system further includes the foregoing offset feed satellite television antenna, and the offset feed satellite television antenna is set behind the feed.

BRIEF DESCRIPTION OF DRAWINGS

To describe the technical solutions in the embodiments of the present invention more clearly, the following outlines the accompanying drawings required in embodiment description. Apparently, the accompanying drawings in the following description are merely some embodiments of the present invention, and persons of ordinary skill in the art may still derive other drawings from the accompanying drawings without creative efforts, where.

DETAILED DESCRIPTION OF THE EMBODIMENTS

The following describes content of the present invention in detail with reference to accompanying drawings.

Figure 6:
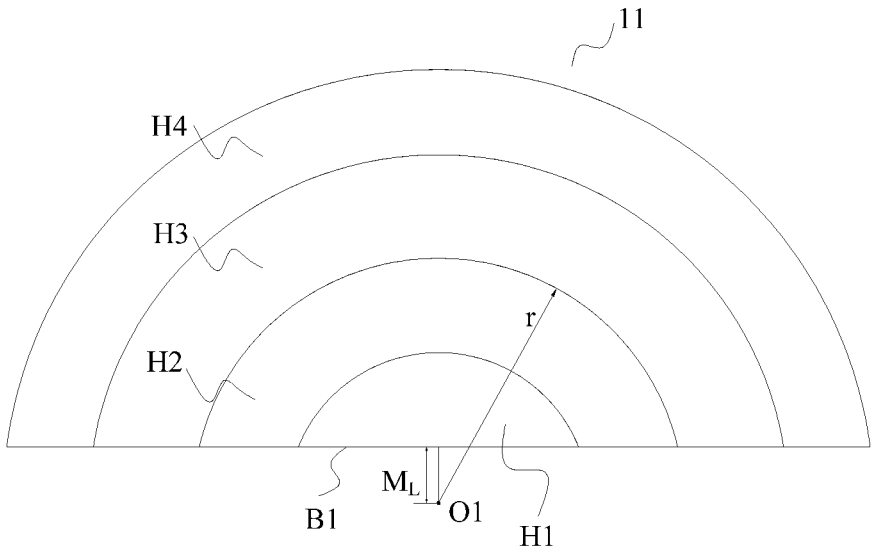
FIG. 6 is a schematic diagram of refractive index profile of a semicircular core layer sheet layer according to Embodiment 1 of the present invention.
Figure 7:
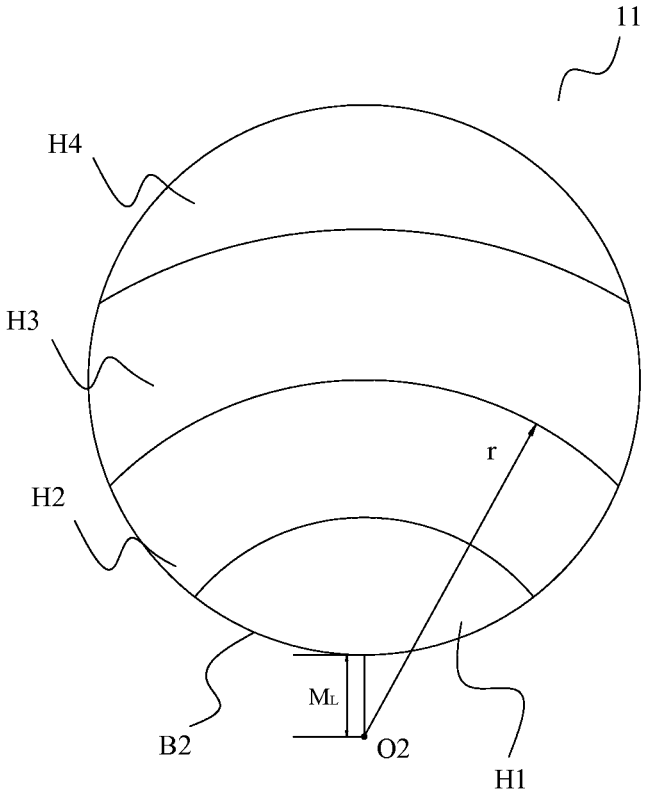
FIG. 7 is a schematic diagram of refractive index profile of a circular core layer sheet layer according to Embodiment 1 of the present invention.
Figure 8:
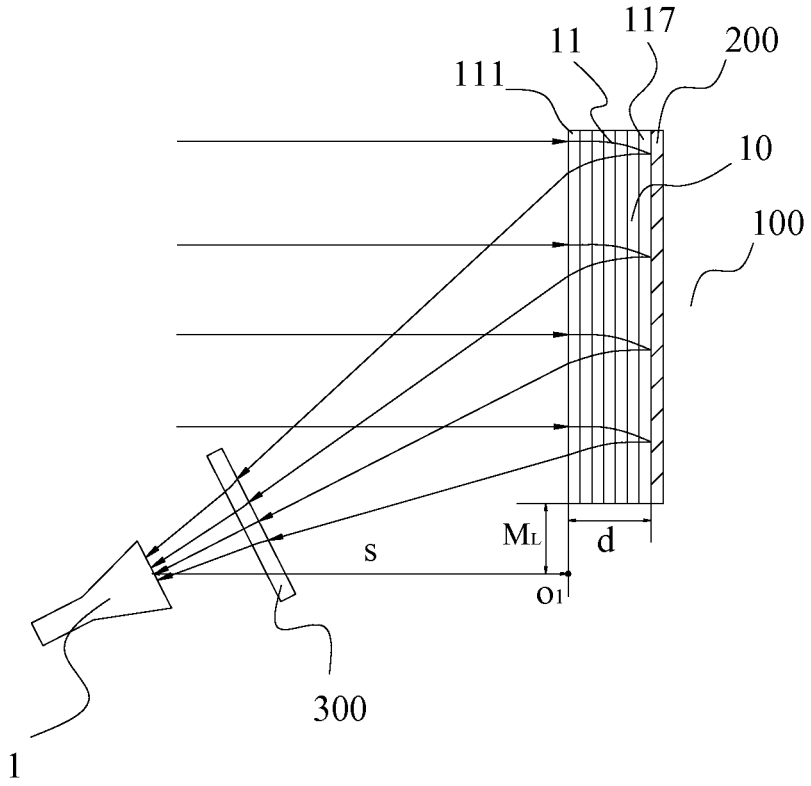
FIG. 8 is a schematic structural diagram of an offset feed satellite television antenna according to Embodiment 2 of the present invention.

As shown in FIG. 1 to FIG. 4, an offset feed satellite television antenna of the present invention includes a metamaterial panel 100 that is set behind a feed 1, where the metamaterial panel 100 includes a core layer 10 and a reflective panel 200 that is set on a surface on a side of the core layer, the core layer 10 includes at least one core layer sheet layer 11, the core layer sheet layer includes a sheet-shaped substrate 13 and a plurality of artificial microstructures 12 (see FIG. 2*a*) that are set on the substrate 13, the core layer sheet layer 11 is divisible into a plurality of strip regions (indicated by H1, H2, H3, H4, and H5 in the diagrams respectively) according to refractive index profile, refractive indexes at a same radius that uses a specific point as a circle center in the a plurality of strip regions are the same and the refractive index decreases gradually with increase of the radius in each strip region, and, among two adjacent strip regions, a minimum value of the refractive index of a strip region located at an inner side is less than a maximum value of the refractive index of a strip region located at an outer side, a line that connects the circle center and the feed 1 is vertical to the core layer sheet layer 11, and the circle center does not coincide with a center of the core layer sheet layer 11, that is, the feed 1 is not on an axis of the core layer sheet layer 11, thereby implementing offset feeding of the antenna. Both the feed 1 and the metamaterial panel 100 are supported by a bracket. The diagram does not show the bracket because it is not the essence of the present invention. A traditional supporting manner is appropriate. In addition, the feed is preferably a horn antenna. In the present invention, the circle center is set in a location that is $M_L$ away from a lower edge of the core layer sheet layer, so as to avoid impact by a feed shadow and improve antenna gain on the same conditions of antenna area, processing precision and receiving frequency. The core layer sheet layer 11 in FIG. 2*a* takes on a cubic shape. In this case, the $M_L$ represents a distance between the circle center O1 and a midpoint B2 of the lower edge B1. However, the core layer sheet layer 11 may also be another shape such as a semicircular shape shown in FIG. 6. The shapes shown in FIG. 2 and FIG. 6 have a common point that their lower edges B1 are both straight lines while the distance between the circle center O1 and the midpoint Z1 of the lower edge B1 is $M_L$. Of course, the core layer sheet layer 11 may also be a circle shown in FIG. 7. The lower edge B2 of the circle shown in FIG. 7 may be regarded as an arc (curve), that is, the lower edge B2 is a curve. In this case, the $M_L$ represents a distance between the circle center O2 and a vertex Z2 of the lower edge B2, that is, the distance between the circle center O2 and the midpoint Z2 of the lower edge B2 is $M_L$. The shape of the core layer sheet layer may be other shapes as required, which may be regular shapes or irregular shapes. In a case that the feed is a horn antenna, a value of the $M_L$ depends on an opening angle and a tilt angle of the horn antenna, which may be adjusted reasonably according to different needs. Such a design is good in that the entire core layer can be brought into play. The value of the $M_L$ may be zero, which can still implement the present invention although the effect is a little worse. In addition, in the present invention, the reflective panel is a metal reflective panel with a smooth surface, such as a polished copper plate, aluminum plate or iron plate.

As shown in FIG. 1 to FIG. 4, the core layer 10 includes a plurality of core layer sheet layers 11 that are parallel to each other. The a plurality of core layer sheet layers 11 fit closely together, and may be bonded to each other by using double-sided tapes or may be connected fixedly by using bolts. In addition, the core layer sheet layer 11 further includes a filler layer 15 that covers an artificial microstructure 12. The filler layer 15 may be air or another dielectric plate, and is preferably a plate part made of the same material as that of the substrate 13. Each core layer sheet layer 11 may be divided into a plurality of same metamaterial units D. Each metamaterial unit D is constructed of an artificial microstructure 12, a unit substrate V and a unit filler layer W. Each core layer sheet layer 11 has only one metamaterial unit D in a thickness direction. Each metamaterial unit D may be exactly the same block, which may be a cube or a cuboid. Length, width and height in geometric dimensions of each metamaterial unit D are not greater than one-fifth of a wavelength of an incident electromagnetic wave (and are generally one-tenth of the wavelength of the incident electromagnetic wave), so that the entire core layer makes continuous electric and/or magnetic responses to the electromagnetic wave. Preferably, the metamaterial unit D is a cube whose side is one-tenth of the wavelength of the incident electromagnetic wave. Of course, the thickness of the filler layer is adjustable. Its minimum value is as small as 0, which means no need of the filler layer. In this case, the substrate and the artificial microstructure make up a metamaterial unit. That is, in this case, the thickness of the metamaterial unit D is equal to the thickness of the unit substrate V plus the thickness of the artificial microstructure. However, in this case, the thickness of the metamaterial unit D also needs to meet the requirement of being one-tenth of the wavelength. Therefore, in fact, in a case that the selected thickness of the metamaterial unit D is one-tenth of the wavelength, the thicker a unit substrate V is, the thinner a unit filler layer W will be. An optimal scenario is shown in FIG. 2*a*, where the thickness of the unit substrate V is equal to the thickness of the unit filler layer W and the material of the unit substrate V is the same as that of the filler layer W.

The artificial microstructure 12 in the present invention is preferably a metal microstructure, where the metal microstructure is formed of one or more metal wires. The metal wires themselves have specific width and thickness. The metal microstructure in the present invention is preferably a metal microstructure with isotropic electromagnetic parameters, such as a planar snowflake metal microstructure shown in FIG. 2*a*.

For an artificial microstructure that has a planar structure, isotropy means that, for any electromagnetic wave that is cast onto the two-dimensional plane at any angle, an electric response and a magnetic response made by the artificial microstructure on the plane are the same, that is, permittivity and permeability are the same; for an artificial microstructure that has a three-dimensional structure, isotropy means that, for any electromagnetic wave that is cast in any direction of the three-dimensional space, an electric response and a magnetic response made by each of the artificial microstructures in the three-dimensional space are the same. If the artificial microstructure is a 90-degree rotational symmetric structure, the artificial microstructure is characterized by isotropy.

For the two-dimensional planar structure, 90-degree rotational symmetry means that, after the structure rotates around a rotation axis on the plane by any 90 degrees, the rotated structure coincides with the original structure, where the rotation axis is vertical to the plane and passes through a center of symmetry of the two-dimensional planar structure; and, for the three-dimensional structure, the structure is a 90-degree rotational symmetric structure if there are 3 rotation axes that are vertical to each other and have a common intersection point (the intersection point is a rotation center), where the rotation axes cause the structure to coincide with the original structure or to be symmetric to the original structure around an interface after the structure rotates around any rotation axis by 90 degrees.

Figure 2A:
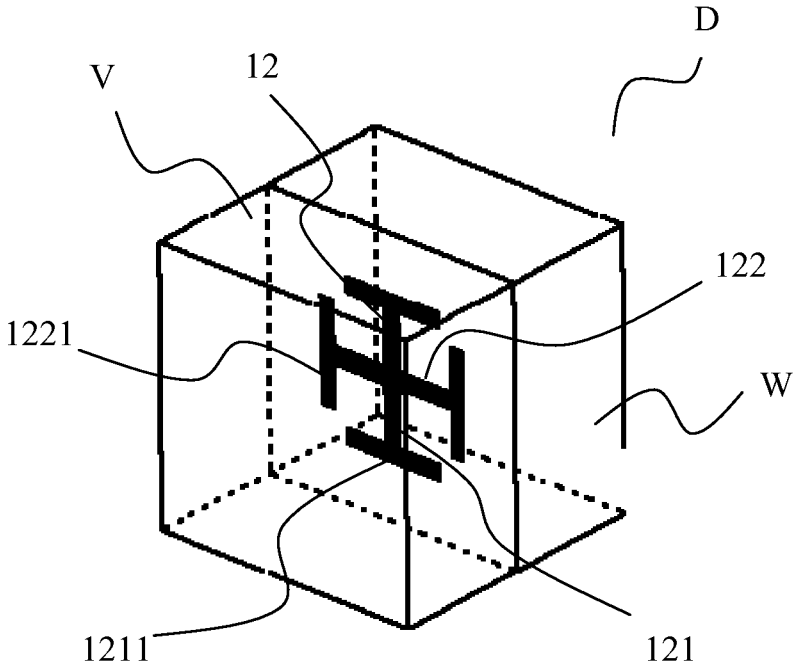
FIGS. 2*a*-2*b* are schematic perspective diagrams of a metamaterial unit that comes in two types of structures according to Embodiment 1 of the present invention.

The planar snowflake metal microstructure shown in FIG. 2*a* is a form of an isotropic artificial microstructure. The snowflake metal microstructure has a first metal wire 121 and a second metal wire 122 that are vertical to and bisect each other. Two first metal branches 1211 of a same length are connected to both ends of the first metal wire 121, and both ends of the first metal wire 121 are connected to midpoints of the two first metal branches 1211. Two second metal branches 1221 of a same length are connected to both ends of the second metal wire 122, and both ends of the second metal wire 122 are connected to midpoints of the two second metal branches 1211.

It is known that a refractive index is $n=\sqrt{\mu\in}$, where $\mu$ is a relative permeability, $\in$ is a relative permittivity, and $\mu$ and $\in$ are collectively called electromagnetic parameters. Experiments prove that when an electromagnetic wave passes through a dielectric material of heterogeneous refractive indexes, the electromagnetic wave is refracted toward a direction of a greater refractive index (refracted toward a metamaterial unit of a greater refractive index). Therefore, the core layer in the present invention has a convergence function for electromagnetic waves. The electromagnetic waves emitted by a satellite undergo a first convergence action of the core layer, and are then reflected by the reflective panel, and then undergo a second convergence action of the core layer. Therefore, a reasonable design of the refractive index profile of the core layer can cause the electromagnetic waves to converge onto the feed after the electromagnetic waves emitted by the satellite undergo the first convergence, reflection by the reflective panel, and the second convergence consecutively. In a case that the material of the substrate and the material of the filler layer are selected, electromagnetic parameter distribution inside the metamaterial can be obtained by designing the shape and geometric dimensions of the artificial microstructure and/or layout of the artificial microstructure on the substrate, so as to design the refractive index of each metamaterial unit. First, spatial distribution of electromagnetic parameters inside the metamaterial (that is, electromagnetic parameters of each metamaterial unit) is calculated with a view to desired effects of the metamaterial, and the shape and geometric dimensions of the artificial microstructure (data of a plurality of types of artificial microstructures is stored in a computer beforehand) on each metamaterial unit are selected according to the spatial distribution of the electromagnetic parameters. An exhaustion method may be applied to design of each metamaterial unit. For example, an artificial microstructure of a specific shape is selected first for calculating electromagnetic parameters, and an obtained result is compared with what is desired. The foregoing process is repeated cyclically until the desired electromagnetic parameters are found. If the desired electromagnetic parameters are found, the selection of design parameters of the artificial microstructure is complete; otherwise, another type of artificial microstructure is substituted to repeat the foregoing cyclic process until the desired electromagnetic parameters are found. If the desired electromagnetic parameters are still not found, the foregoing process will not stop. That is, the process does not stop until the artificial microstructure of the desired electromagnetic parameters is found. Because this process is performed by the computer, the process can be completed quickly although it seems complicated.

The substrate of the core layer is made of a ceramic material, a polymer material, a ferroelectric material, a ferrite material, or a ferromagnetic material. Optional polymer materials are Teflon, epoxy, an F4B composite material, an FR-4 composite material, and the like. For example, electric insulativity of the Teflon is very high, and hence will not cause interference onto an electric field of the electromagnetic wave, and the Teflon is characterized by excellent chemical stability, corrosion resistance, and a long life.

The metal microstructure is a metal wire such as a copper wire or a silver wire. The metal wires may be attached onto the substrate by means of etching, plating, drill-lithography, photolithography, electron lithography, or ion lithography. Of course, three-dimensional laser processing may also be applied.

Figure 1:
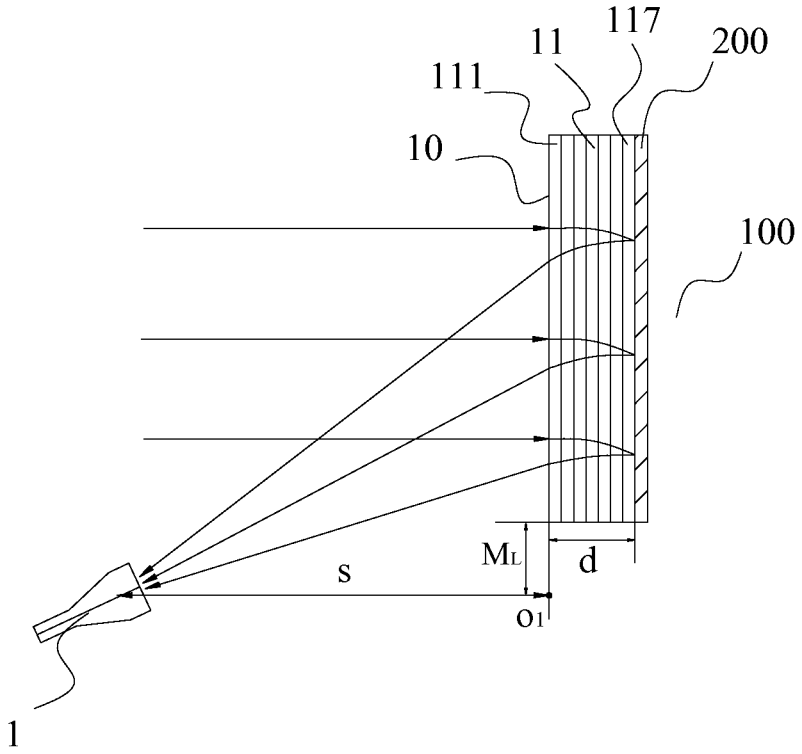
FIG. 1 is a schematic structural diagram of an offset feed satellite television antenna according to Embodiment 1 of the present invention.

FIG. 1 is a schematic structural diagram of a metamaterial panel according to the present invention. All strip regions of a core layer sheet layer 117 close to the reflective panel among the a plurality of core layer sheet layers 11 have a same refractive index range, that is, refractive indexes of each strip region decrease from a maximum value $n_{max}$ to a minimum value $n_{min}$ continuously. For example, $n_{max}$ may have a value of 6, and $n_{min}$ may have a value of 1, that is, the refractive indexes of each strip region decrease from 6 to 1 continuously. The refractive index profile of the core layer sheet layer 117 satisfies the following formulas:

$$n(r)_m = n_{max} - \frac{\sqrt{r^2+s^2} - \sqrt{(M_L+seg_k)^2+s^2}}{d} \tag{1}$$

$$seg_k = \sqrt{(v_0+k\lambda)^2-s^2} - \sqrt{v_0^2-s^2} \tag{2}$$

$$k = \text{floor}\left\{\frac{\sqrt{\left(|r-M_L|+\sqrt{v_o^2-s^2}\right)^2+s^2} - v_o}{\lambda}\right\} \tag{3}$$

$$v_o = \sqrt{M_L^2+s^2} \tag{4}$$

where, $n(r)_m$ represents a refractive index value at a radius of r on the core layer sheet layer, that is, a refractive index of the metamaterial unit D whose radius is r on the core layer sheet layer, where the radius refers to a distance from a midpoint of each unit substrate V to the circle center O1, and the midpoint of the unit substrate V refers to a midpoint of a surface located in the same plane as that of the unit substrate V and the circle center O1. m represents the serial number of the core layer sheet layer and the total number of the core layer sheet layers.

s is a vertical distance from the feed 1 to a core layer sheet layer 111 close to the feed.

d is thickness of the core layer.

In the formulas, floor refers to rounding down; k may also be used to represent the serial number of the strip region. If k=0, it indicates a first strip region H1; and, if k=1, it indicates a second strip region H2 adjacent to the first strip region H1, and so on. The maximum value of r determines how many strip regions exist. The thickness of each core layer sheet layer is generally definite (generally one-tenth of the wavelength of the incident electromagnetic wave). Therefore, in a case that a core layer shape is selected (which may be cylindric or cubic), dimensions of the core layer sheet layer can be determined.

The core layer 10 determined by formula (1), formula (2), formula (3), and formula (4) can ensure that the electromagnetic waves emitted by the satellite converge at the feed 1. This can be obtained through computer simulation or by using principles of optics (that is, calculation performed in view of equal optical paths).

In this embodiment, the thickness of the core layer sheet layer 11 is definite, and is generally less than one-fifth of the wavelength $\lambda$ of the incident electromagnetic wave, and is preferably one-tenth of the wavelength $\lambda$ of the incident electromagnetic wave. In this way, if a working frequency is selected (that is, the wavelength is definite), in view of assembly space requirements of the antenna, other variables in the foregoing formulas are designed properly so that the electromagnetic waves emitted by the satellite converge at the feed 1. Antennas of any frequency can be designed in such a manner to design the offset feed satellite television antenna of a desired frequency such as a C band and a Ku band. A frequency range of the C band is 3400 MHz~4200 MHz. Frequencies of the Ku band are 10.7~12.75 GHz, which may be divided into bands such as 10.7~11.7 GHz, 11.7~12.2 GHz, and 12.2~12.75 GHz.

As shown in FIG. 1, in this embodiment, refractive index profile of other core layer sheet layers satisfies the following formula:

$$n(r)_j = n_{min} + \frac{j}{m}(n(r)_m - n_{min}) \tag{5}$$

where, j represents a serial number of the core layer sheet layer, the serial number of the core layer sheet layer close to the reflective panel is m, the serial number decreases consecutively in a direction from the reflective panel to the feed, and the serial number of the core layer sheet layer close to the feed is 1.

In this embodiment, as shown in FIG. 1, the core layer is formed of 7 core layer sheet layers, that is, m=7. That is, in a direction from the reflective panel to the feed, the refractive index profile of each core layer sheet layer is given below consecutively:

*a* $7^{th}$ core layer sheet layer:

$$n(r)_7 = n_{max} - \frac{\sqrt{r^2+s^2} - \sqrt{(M_L + seg_k)^2 + s^2}}{d}$$

*a* $6^{th}$ core layer sheet layer:

$$n(r)_6 = n_{min} + \frac{6}{7}(n(r)_7 - n_{min})$$

*a* $5^{th}$ core layer sheet layer:

$$n(r)_5 = n_{min} + \frac{5}{7}(n(r)_7 - n_{min})$$

*a* $4^{th}$ core layer sheet layer:

$$n(r)_4 = n_{min} + \frac{4}{7}(n(r)_7 - n_{min})$$

*a* $3^{rd}$ core layer sheet layer:

$$n(r)_3 = n_{min} + \frac{3}{7}(n(r)_7 - n_{min})$$

*a* $2^{nd}$ core layer sheet layer:

$$n(r)_2 = n_{min} + \frac{2}{7}(n(r)_7 - n_{min})$$

*a* $1^{st}$ core layer sheet layer:

$$n(r)_1 = n_{min} + \frac{1}{7}(n(r)_7 - n_{min})$$

Figure 4:
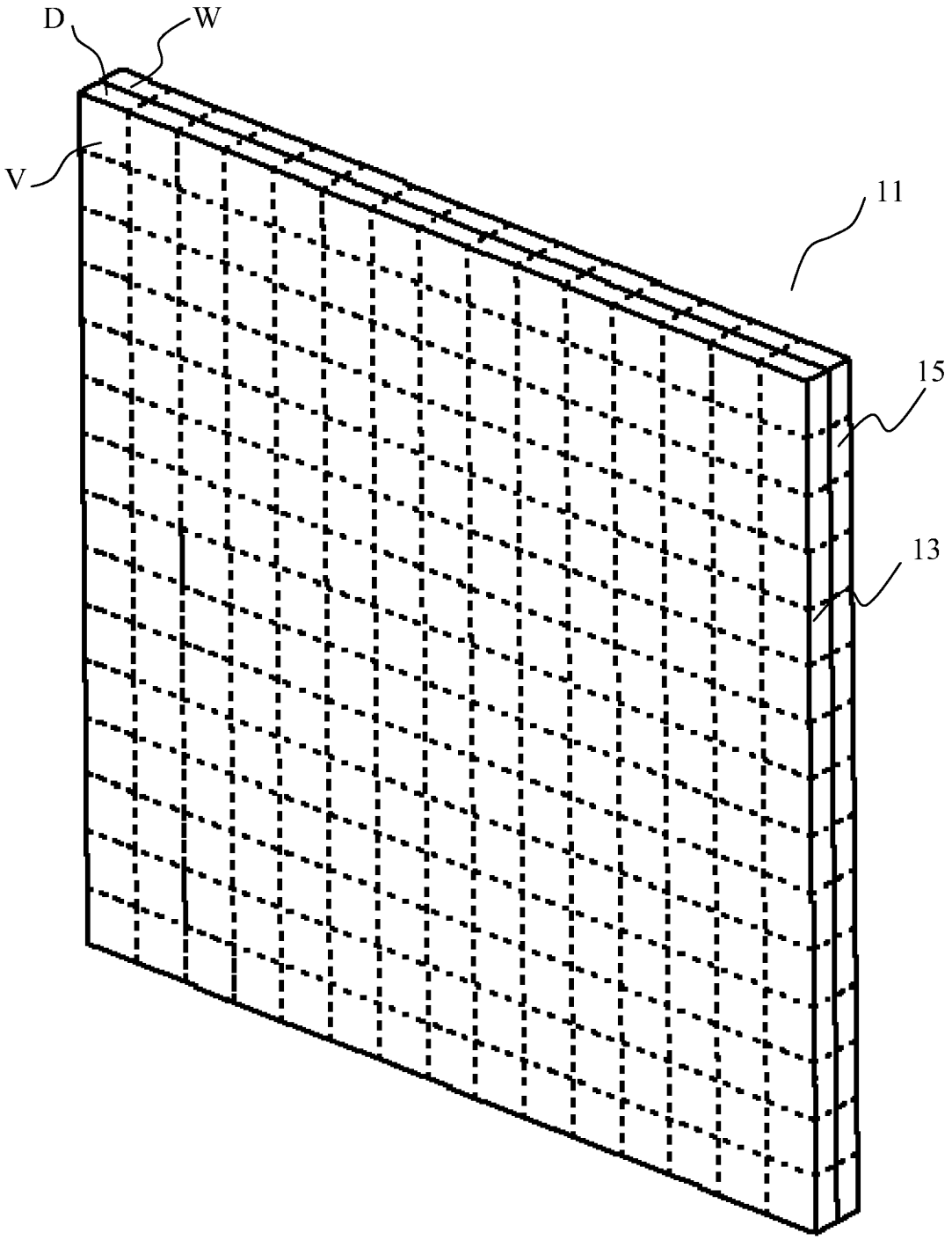
FIG. 4 is a schematic structural diagram of a form of core layer sheet layer according to Embodiment 1 of the present invention.

FIG. 4 shows a form of core layer sheet layer 11. A plurality of artificial microstructures 12 of each core layer sheet layer 11 of the core layer have a same shape, which is a snowflake metal microstructure uniformly. A center point of the metal microstructure coincides with a midpoint of a unit substrate V. A plurality of artificial microstructures at the same radius have same geometric dimensions, the geometric dimensions of the artificial microstructures 12 decrease gradually with increase of the radius in each strip region, and, among two adjacent strip regions, a minimum value of the geometric dimensions of the artificial microstructure 12 of a strip region located at an inner side is less than a maximum value of the geometric dimensions of the artificial microstructure 12 of a strip region located at an outer side. Because the refractive index of each metamaterial unit decreases gradually with decrease of the dimensions of the metal microstructure, if the geometric dimensions of the artificial microstructure are larger, the corresponding refractive index is greater. Therefore, in this way, the refractive index profile of the core layer sheet layer can comply with formula (1).

Depending on different requirements (different electromagnetic waves) and different design requirements, the core layer 10 may include different numbers of core layer sheet layers 11 shown in FIG. 4.

Figure 2B:
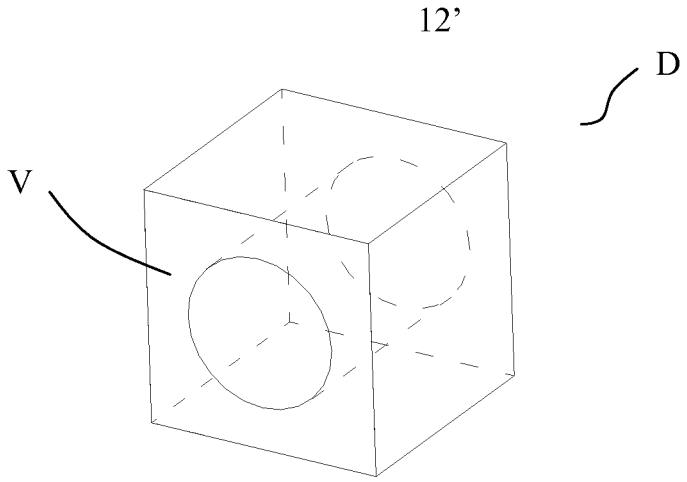
Figure 3:
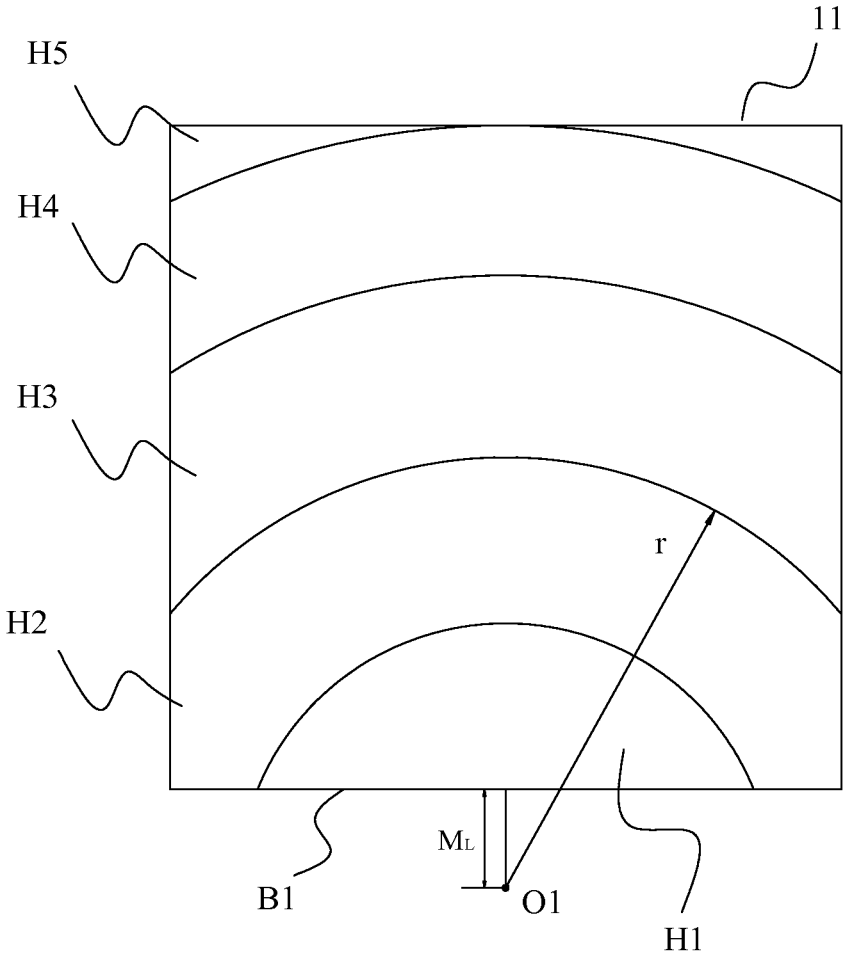
FIG. 3 is a schematic diagram of refractive index profile of a cubic core layer sheet layer according to Embodiment 1 of the present invention.

See FIG. 2*b*, which shows a substitute structure of Embodiment 1 of the present invention, in which the microstructure 12 that is set on the substrate 13 is replaced with a plurality of artificial pore structures 12'. The core layer sheet layer 11 may be divided into a plurality of strip regions (represented by H1, H2, H3, H4, and H5 respectively in the diagram) according to refractive index profile. Refractive indexes at a same radius that uses a specific point as a circle center in the a plurality of strip regions are the same and the refractive index decreases gradually with increase of the radius in each strip region, and, among two adjacent strip regions, a minimum value of the refractive index of a strip region located at an inner side is less than a maximum value of the refractive index of a strip region located at an outer side. A line that connects the circle center and the feed 1 is vertical to the core layer sheet layer 11, and the circle center does not coincide with a center of the core layer sheet layer 11, that is, the feed 1 is not on an axis of the core layer sheet layer 11, thereby implementing offset feeding of the antenna.

In a case that the material of the substrate and the material of a filler medium are selected, electromagnetic parameter distribution inside the metamaterial can be obtained by designing the shape and size of the artificial pore structure 12' and/or layout of the artificial pore structure on the substrate, so as to design the refractive index of each metamaterial unit. First, spatial distribution of electromagnetic parameters inside the metamaterial (that is, electromagnetic parameters of each metamaterial unit) is calculated with a view to desired effects of the metamaterial, and the shape and size of the artificial pore structure 12' (data of a plurality of types of artificial pore structures is stored in a computer beforehand) on each metamaterial unit are selected according to the spatial distribution of the electromagnetic parameters. An exhaustion method may be applied to design of each metamaterial unit. For example, an artificial pore structure 12' of a specific shape is selected first for calculating electromagnetic parameters, and an obtained result is compared with what is desired. The foregoing process is repeated cyclically until the desired electromagnetic parameters are found. If the desired electromagnetic parameters are found, the selection of design parameters of the artificial pore structure 12' is complete; otherwise, another type of artificial pore structure is substituted to repeat the foregoing cyclic process until the desired electromagnetic parameters are found. If the desired electromagnetic parameters are still not found, the foregoing process will not stop. That is, the process does not stop until the artificial pore structure 12' of the desired electromagnetic parameters is found. Because this process is performed by the computer, the process can be completed quickly although it seems complicated.

The artificial pore structure 12' may be formed on the substrate by means of high-temperature sintering, injection molding, stamping or computerized numerical control punching. However, for the substrate of a different material, the manner of generating the artificial pore structure 12' is different. For example, if a ceramic material is used as a substrate, the high-temperature sintering is a preferred manner of generating the artificial pore structure 12' on the substrate. If a polymer material such as Teflon and epoxy is used as the substrate, the injection molding or stamping is preferred as a manner of generating the artificial pore structure 12' on the substrate.

The artificial pore structure 12' in the present invention may be a cylindric pore, a conic pore, a truncated cone pore, a trapezoidal pore, or a square pore, or any combination thereof. Of course, other forms of pores may be applied instead. The shapes of the artificial pore structures on each metamaterial unit D may be the same or different, depending on different needs. However, the pores of the same shape are preferred for the entire metamaterial in order to facilitate processing and manufacturing.

Figure 5:
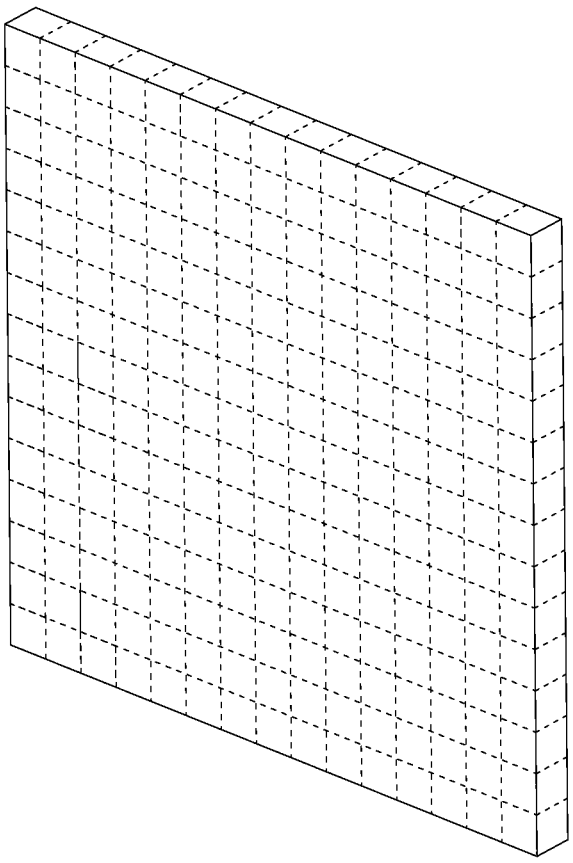
FIG. 5 is a schematic structural diagram of another form of core layer sheet layer according to Embodiment 1 of the present invention.

FIG. 5 shows another form of core layer 10 according to Embodiment 1 of the present invention. A plurality of artificial pore structures 12' of each core layer sheet layer 11 of the core layer have a same shape, the a plurality of artificial pore structures 12' are filled with a medium whose refractive index is less than that of the substrate 13, and a plurality of artificial pore structures at the same radius have same size, the size of the artificial pore structures 12' increases gradually with increase of the radius in each strip region, and, among two adjacent strip regions, a maximum value of the size of the artificial pore structure 12' of a strip region located at an inner side is greater than a minimum value of the size of the artificial pore structure 12' of a strip region located at an outer side. Because the artificial pore structures 12' are filled with the medium whose refractive index is less than that of the substrate, if the size of the artificial pore structure is larger, the structure is filled with more mediums but the corresponding refractive index is smaller. Therefore, in this way, the refractive index profile of the core layer sheet layer can comply with formula (1).

Seen from outer appearance, FIG. 4 and FIG. 5 are exactly the same, and the refractive index profile is also the same, but the manner of implementing the refractive index profile is different (the filler medium is different).

See FIGS. 8-14, an offset feed satellite television antenna is provided in Embodiment 2 of the present invention. On the basis of Embodiment 1, a diverging component 200 that has an electromagnetic wave divergence function is further set behind the feed 1, and is located before the metamaterial panel 100.

Figure 9:
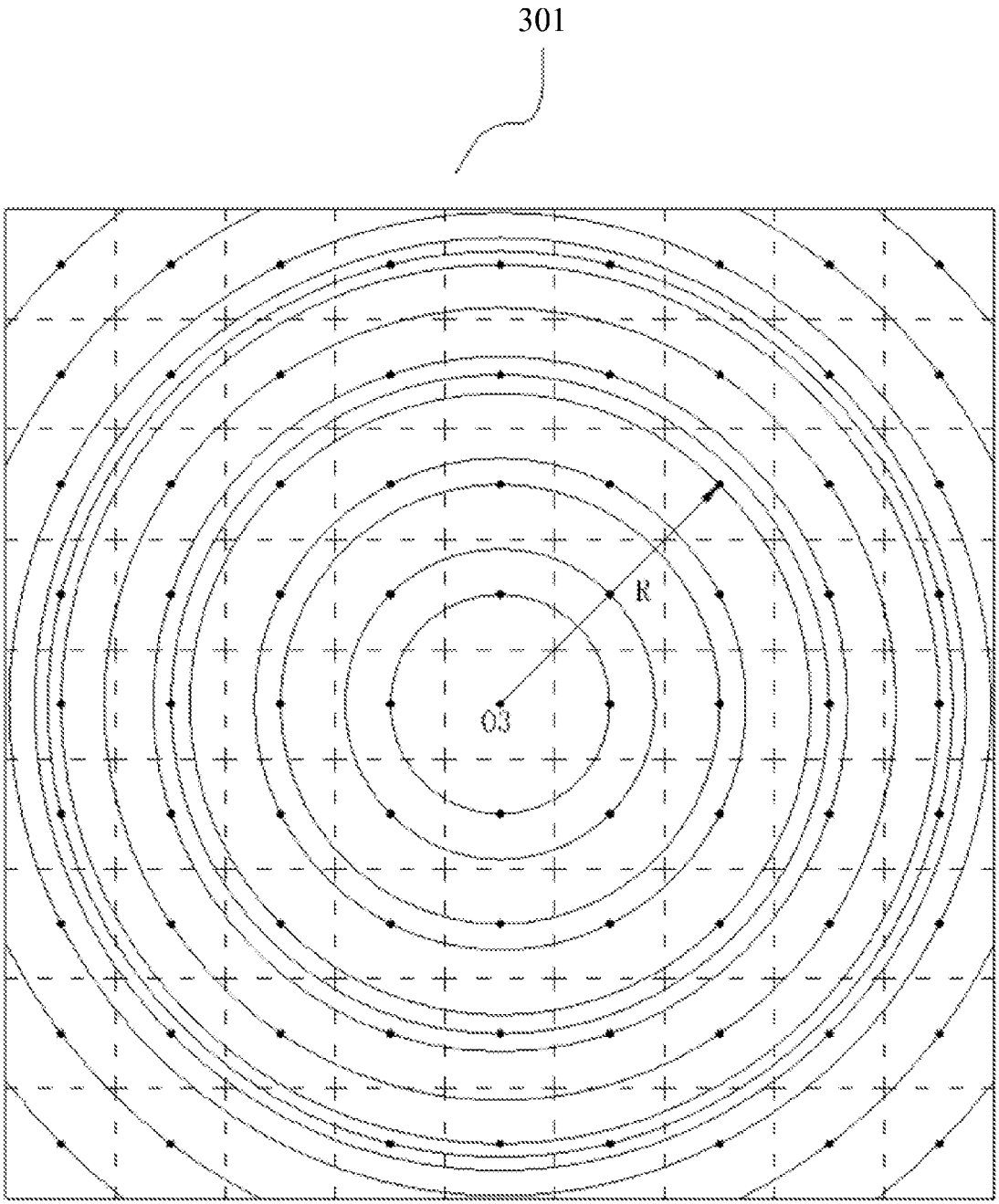
FIG. 9 is a schematic diagram of refractive index profile of a diverging sheet layer according to Embodiment 2 of the present invention.
Figure 12:
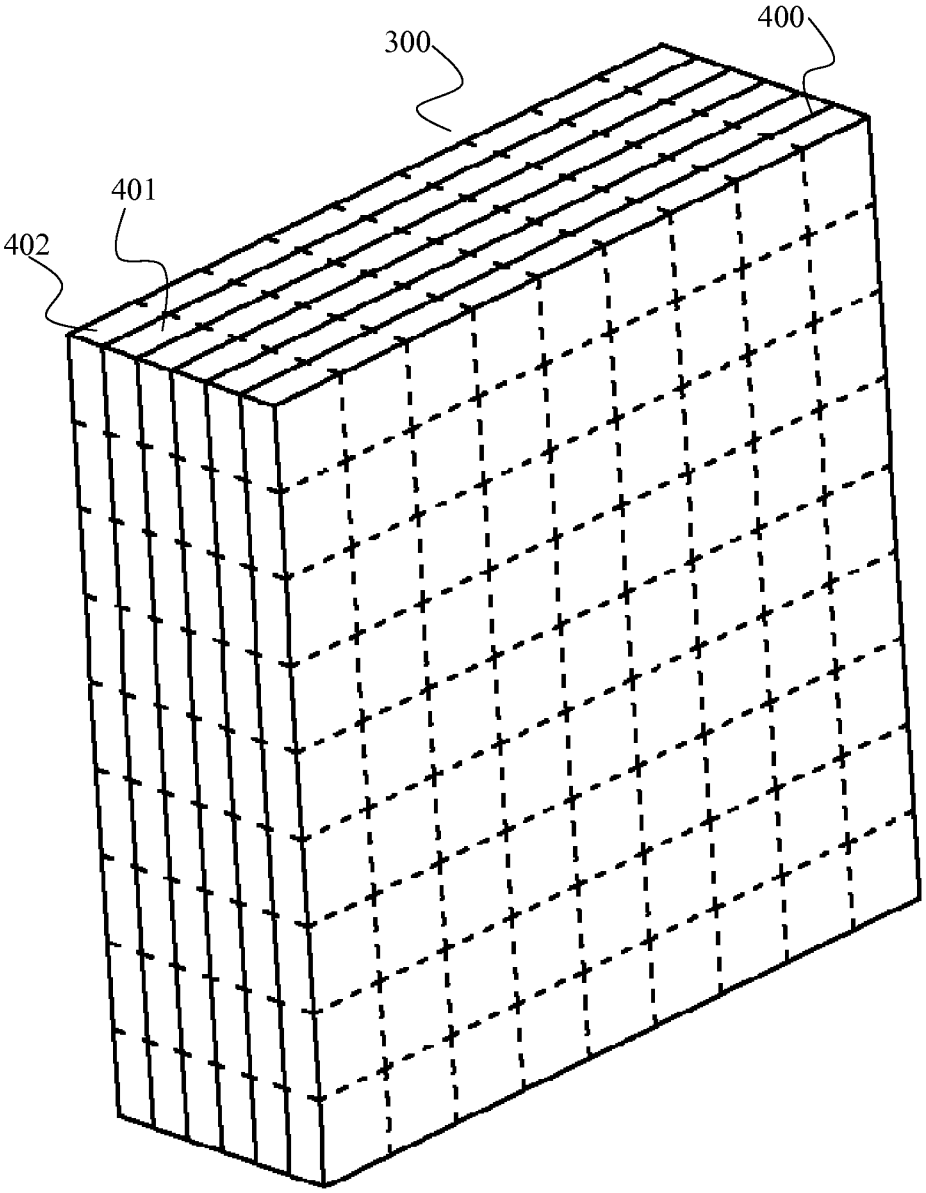
FIG. 12 is a schematic structural diagram of a diverging metamaterial panel with a plurality of diverging sheet layers shown in FIG. 10.
Figure 14:
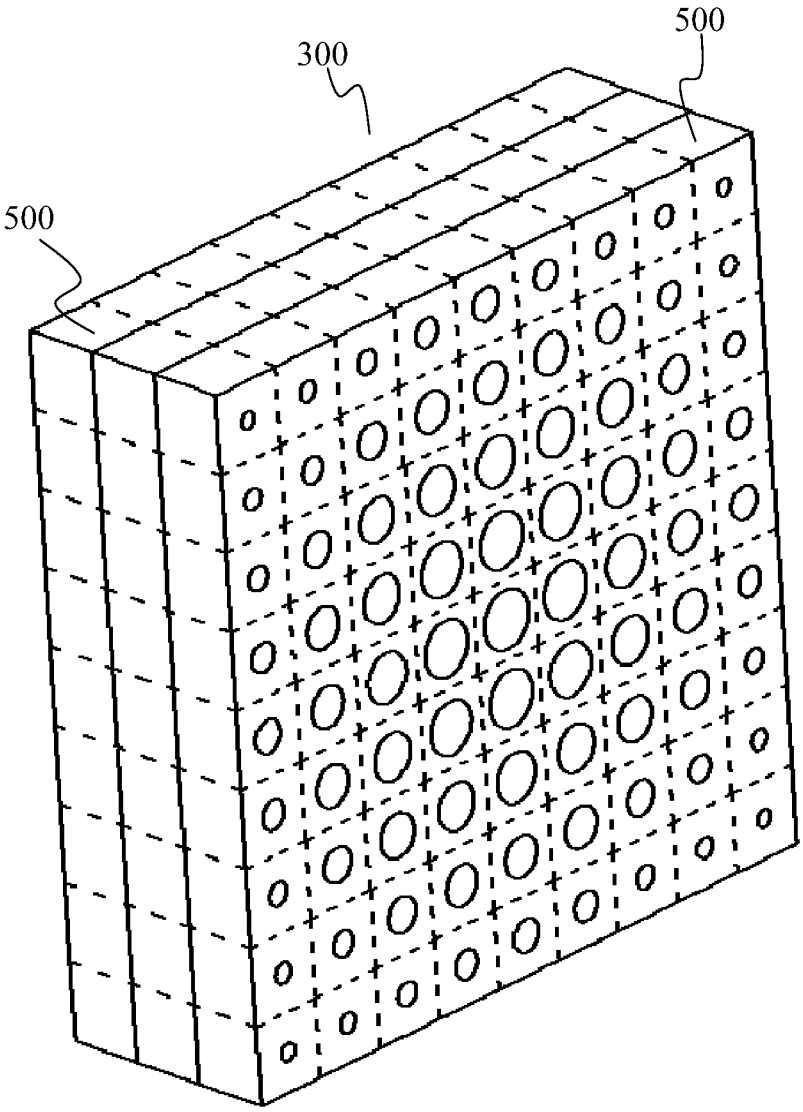
FIG. 14 is a schematic structural diagram of a diverging metamaterial panel with a plurality of diverging sheet layers shown in FIG. 13.

The diverging component 200 may be a concave lens or a diverging metamaterial panel 300 shown in FIG. 12 or FIG. 14. The diverging metamaterial panel 300 includes at least one diverging sheet layer 301. The refractive indexes of the diverging sheet layer 301 are shown in FIG. 9. The refractive indexes of the diverging sheet layer 301 are distributed in a circular shape using its center O3 as a circle center, and the refractive indexes at the same radius are the same. The refractive index decreases gradually with increase of the radius. A diverging component that has an electromagnetic wave divergence function is set between the metamaterial panel and the feed, and brings the following effects: in a case that the range of electromagnetic waves received by the feed is definite (that is, the range of radiation of electromagnetic waves received by the metamaterial panel is definite), a distance between the feed and the metamaterial panel decreases as against a case that no diverging component is applied, thereby reducing the size of the antenna significantly.

A refractive index profile law on the diverging sheet layer 301 may be to change linearly, that is, $n_R=n_{min}+KR$, where K is a constant, R represents radius (using a center O3 of the diverging sheet layer 301 as a circle center), and $n_{min}$ is a minimum value of the refractive index on the diverging sheet layer 301, that is, the refractive index at the center O3 of the diverging sheet layer 301. In addition, the refractive index profile law on the diverging sheet layer 301 may also be to change according to a square law, that is, $n_R=n_{min}+KR^2$; or may be to change according to a cubic law, that is, $n_R=n_{min}+KR^3$; or may be to change according to a power function, that is, $n_R=n_{min}*K^R$, and the like.

Figure 11:
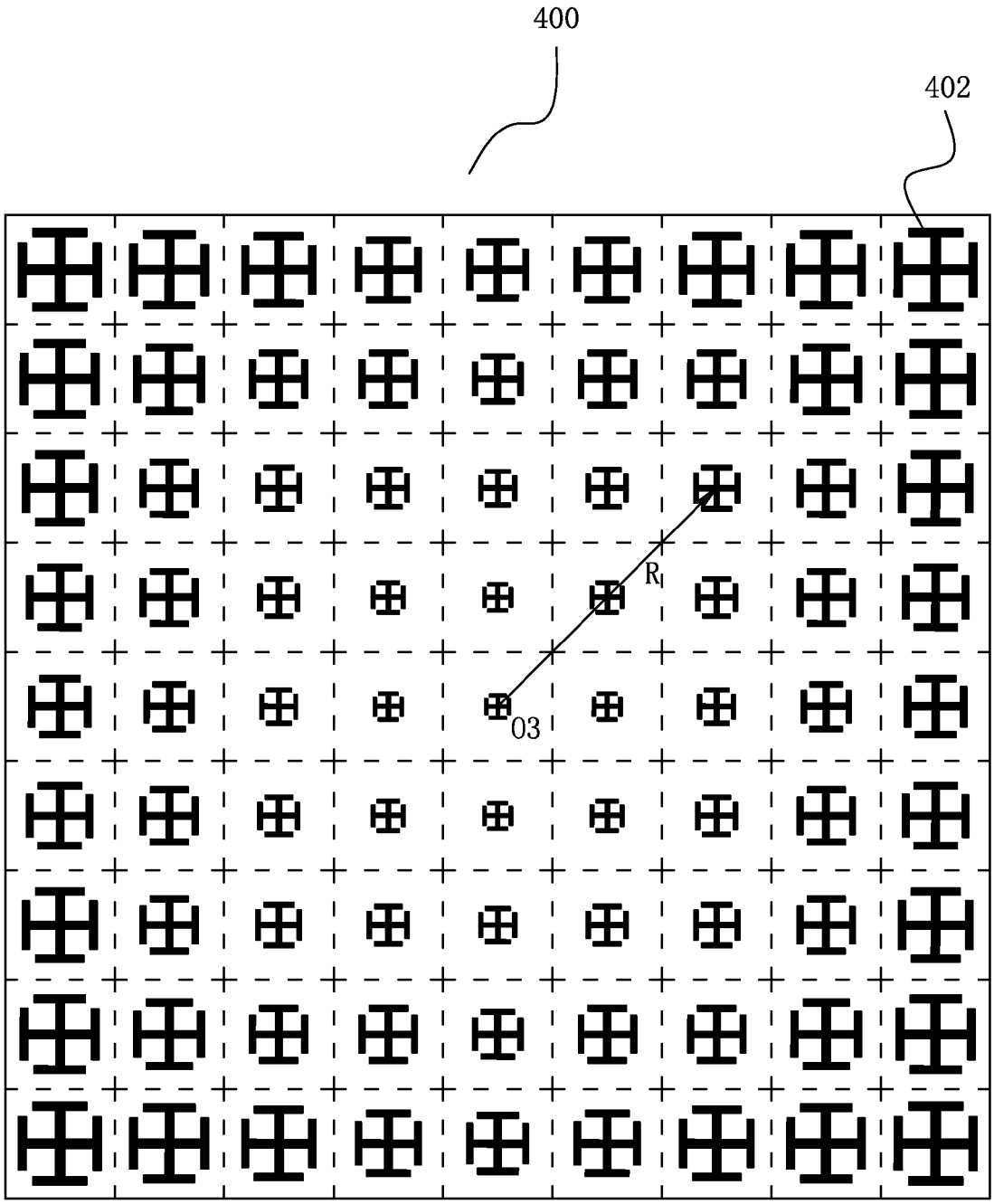
FIG. 11 is a front view of the structure shown in FIG. 10 but without a substrate.

FIG. 12 shows a form of diverging sheet layer 400 for implementing the refractive index profile shown in FIG. 11. As shown in FIG. 12 and FIG. 11, the diverging sheet layer 400 includes a sheet-shaped substrate 401, a metal microstructure 402 attached to the substrate 401, and a support layer 403 that covers the metal microstructure 402. The diverging sheet layer 400 may be divided into a plurality of same first diverging units 404. Each first diverging unit includes a metal microstructure 402, a substrate unit 405 occupied by it, and a support layer unit 406. Each diverging sheet layer 400 has only one first diverging unit 404 in a thickness direction. Each first diverging unit 404 may be an exactly same block, which may be a cube or a cuboid. Length, width and height in the dimensions of each first diverging unit 404 are not greater than one-fifth of a wavelength of an incident electromagnetic wave (and are generally one-tenth of the wavelength of the incident electromagnetic wave), so that the entire diverging sheet layer makes continuous electric and/or magnetic responses to the electromagnetic wave. Preferably, the first diverging unit 404 is a cube whose side is one-tenth of the wavelength of the incident electromagnetic wave. Preferably, a structural form of the first diverging unit 404 in the present invention is the same as that of the metamaterial unit D shown in FIG. 2.

Figure 13:
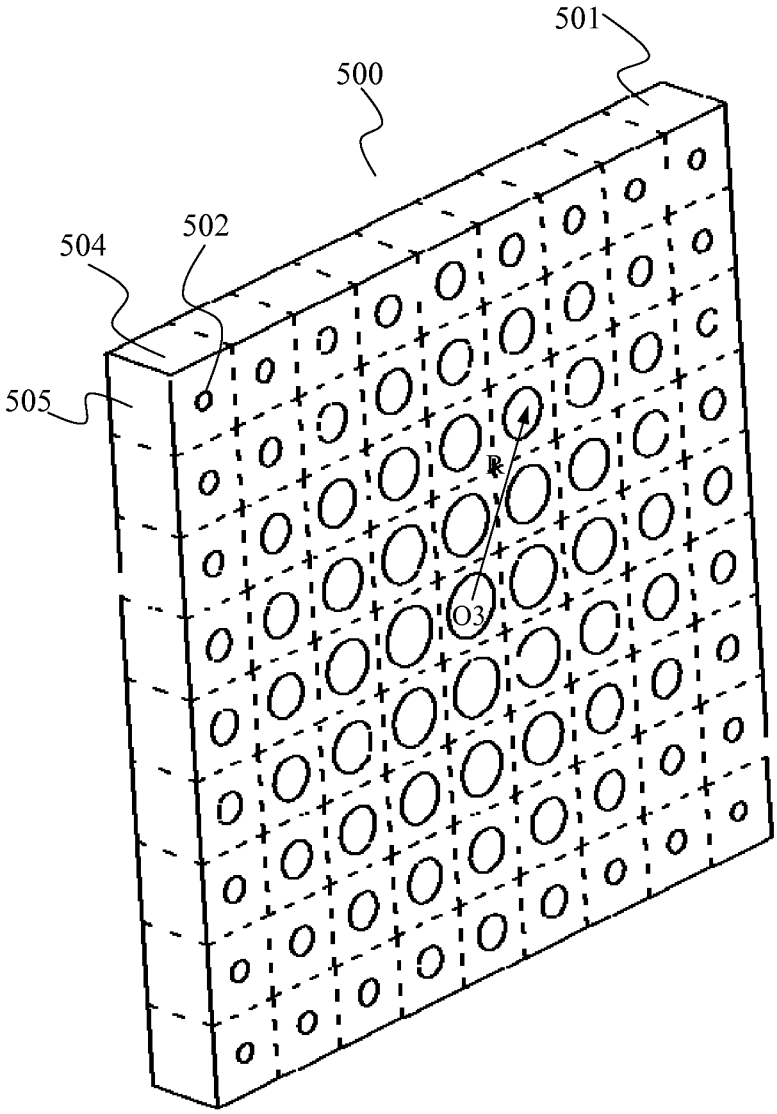
FIG. 13 is a schematic structural diagram of another form of diverging sheet layer according to Embodiment 2 of the present invention.

FIG. 13 is a front view of the structure shown in FIG. 12 but without a substrate. Spatial layout of a plurality of metal microstructures 402 can be clearly seen from FIG. 13. The metal microstructures 402 at the same radius that uses the center O3 of the diverging sheet layer 400 as a circle center (here the O3 is located at a midpoint of a middlemost metal microstructure) have the same geometric dimensions, and the geometric dimensions of the metal microstructures 402 decrease gradually with increase of the radius. The radius here refers to a distance from the center of each metal microstructure 402 to the center O3 of the diverging sheet layer 400.

The substrate 401 of the diverging sheet layer 400 is made of a ceramic material, a polymer material, a ferroelectric material, a ferrite material, or a ferromagnetic material. Optional polymer materials are Teflon, epoxy, an F4B composite material, an FR-4 composite material, and the like. For example, electric insulativity of the Teflon is very high, and hence will not cause interference onto an electric field of the electromagnetic wave, and the Teflon is characterized by excellent chemical stability, corrosion resistance, and a long life.

The metal microstructure 402 is a metal wire such as a copper wire or a silver wire. The metal wires may be attached onto the substrate by means of etching, plating, drill-lithography, photolithography, electron lithography, or ion lithography. Of course, three-dimensional laser processing may also be applied. The metal microstructure 402 may be a planar snowflake metal microstructure shown in FIG. 11, or may be a derivative structure of the planar snowflake metal microstructure, or may be an H-shaped or cross-shaped metal wire.

Figure 10:
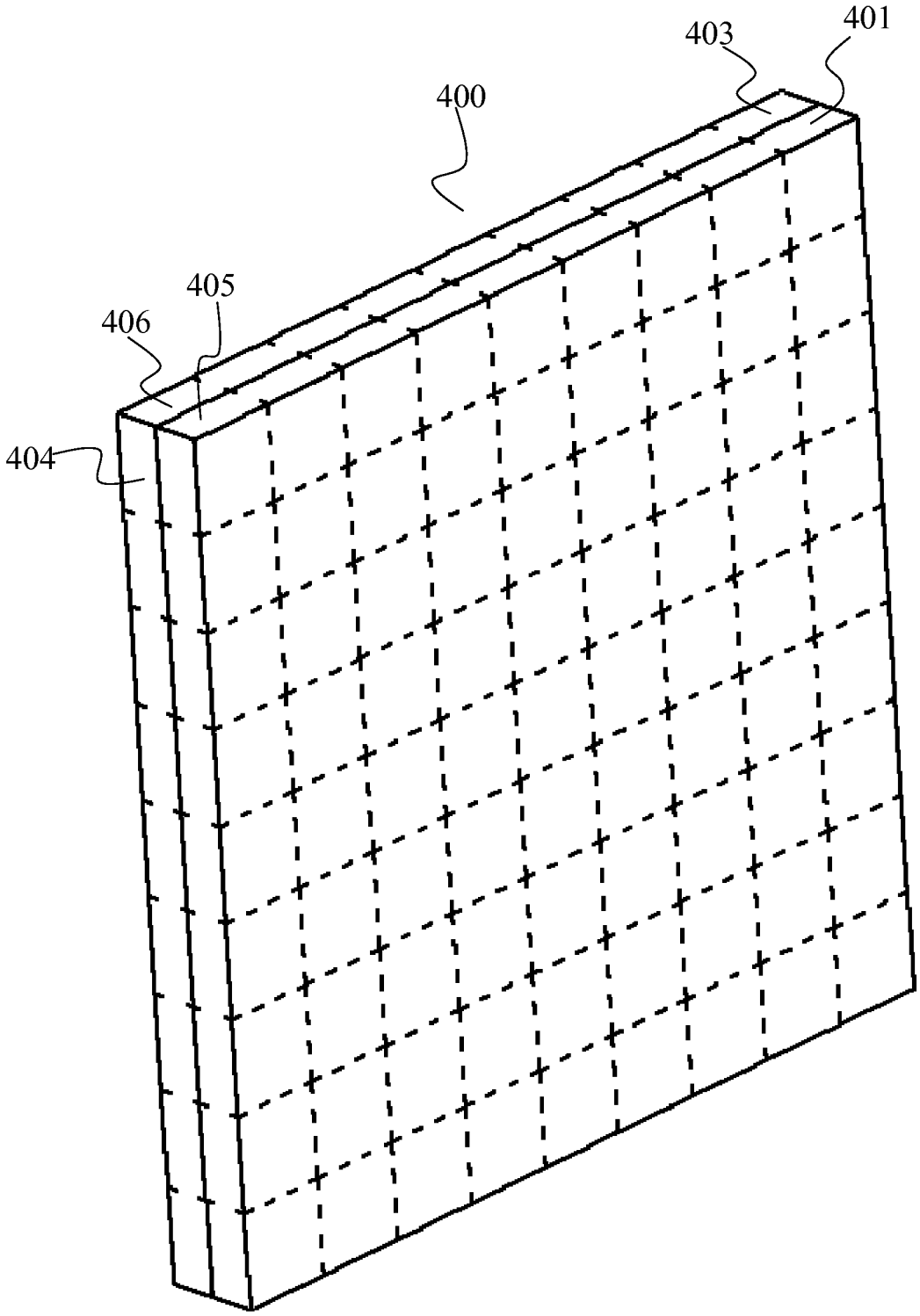
FIG. 10 is a schematic structural diagram of a form of diverging sheet layer according to Embodiment 2 of the present invention.

FIG. 12 shows a diverging metamaterial panel 300 generated by using a plurality of diverging sheet layers 400 shown in FIG. 10. There are three layers shown in FIG. 12. Depending on different needs, the diverging metamaterial panel 300 may be constructed of other different numbers of layers of diverging sheet layers 400. The a plurality of diverging sheet layers 400 fit closely together, and may be bonded to each other by using double-sided tapes or may be connected fixedly by using bolts. In addition, a matching layer shown in FIG. 7 needs to be set on both sides of the diverging metamaterial panel 300 shown in FIG. 12, so as to implement matching of refractive indexes, reduce reflection of electromagnetic waves, and enhance signal receiving.

FIG. 13 shows another form of diverging sheet layer 500 for implementing the refractive index profile shown in FIG. 9. The diverging sheet layer 500 includes a sheet-shaped substrate 501 and an artificial pore structure 502 that is set on the substrate 501. The diverging sheet layer 500 may be divided into a plurality of same second diverging units 504. Each second diverging unit 504 includes an artificial pore structure 502 and a substrate unit 505 occupied by it. Each diverging sheet layer 500 has only one second diverging unit 504 in a thickness direction. Each second diverging unit 504 may be an exactly same block, which may be a cube or a cuboid. Length, width and height in the dimensions of each second diverging unit 504 are not greater than one-fifth of a wavelength of an incident electromagnetic wave (and are generally one-tenth of the wavelength of the incident electromagnetic wave), so that the entire diverging sheet layer makes continuous electric and/or magnetic responses to the electromagnetic wave. Preferably, the second diverging unit 504 is a cube whose side is one-tenth of the wavelength of the incident electromagnetic wave.

As shown in FIG. 13, all the artificial pore structures on the diverging sheet layer 500 are cylindric pores. The artificial pore structures 502 at the same radius that uses the center O3 of the diverging sheet layer 500 as a circle center (here the O3 is on axis of a middlemost artificial pore structure) have the same size, and the size of the metal artificial pore structures 402 decreases gradually with increase of the radius. The radius here refers to a vertical distance from an axis of each artificial pore structure 502 to an axis of the middlemost artificial pore structure of the diverging sheet layer 500. Therefore, if each cylindric pore is filled with a dielectric material whose refractive index is less than that of the substrate (such as air), the refractive index profile shown in FIG. 9 can be implemented. Of course, if the artificial pore structures 502 at the same radius that uses the center O3 of the diverging sheet layer 500 as a circle center have the same size, and the size of the artificial pore structures 402 increases gradually with increase of the radius, each cylindric pore needs to be filled with a dielectric material whose refractive index is greater than that of the substrate, so as to implement the refractive index profile shown in FIG. 9.

Of course, the diverging sheet layer is not limited to the foregoing form. For example, each artificial pore structure may be divided into several unit pores of the same size, and the size of the artificial pore structure on each second diverging unit is controlled according to the number of unit pores on each substrate unit, which can also fulfill the same purpose. For another example, the diverging sheet layer may have the following form: all artificial pore structures of the same diverging sheet layer have the same size, but a refractive index of a filler medium satisfies the profile shown in FIG. 9, that is, the filler medium materials at the same radius have the same refractive index, and the refractive index of the filler medium materials decreases gradually with increase of the radius.

The substrate 501 of the diverging sheet layer 500 is made of a ceramic material, a polymer material, a ferroelectric material, a ferrite material, or a ferromagnetic material. Optional polymer materials are Teflon, epoxy, an F4B composite material, an FR-4 composite material, and the like. For example, electric insulativity of the Teflon is very high, and hence will not cause interference onto an electric field of the electromagnetic wave, and the Teflon is characterized by excellent chemical stability, corrosion resistance, and a long life.

The artificial pore structure 502 may be formed on the substrate by means of high-temperature sintering, injection molding, stamping or computerized numerical control punching. However, for the substrate of a different material, the manner of generating the artificial pore structure is different. For example, if a ceramic material is used as a substrate, the high-temperature sintering is a preferred manner of generating the artificial pore structure on the substrate. If a polymer material such as Teflon and epoxy is used as the substrate, the injection molding or stamping is preferred as a manner of generating the artificial pore structure on the substrate.

The artificial pore structure 502 may be a cylindric pore, a conic pore, a truncated cone pore, a trapezoidal pore, or a square pore, or any combination thereof. Of course, other forms of pores may be applied instead. The shapes of the artificial pore structures on each second diverging unit may be the same or different, depending on different needs. However, the pores of the same shape are preferred for the entire metamaterial in order to facilitate processing and manufacturing.

FIG. 14 shows a diverging metamaterial panel 300 generated by using a plurality of diverging sheet layers 500 shown in FIG. 13. There are three layers shown in FIG. 14. Depending on different needs, the diverging metamaterial panel 300 may be constructed of other different numbers of layers of diverging sheet layers 500. The a plurality of diverging sheet layers 500 fit closely together, and may be bonded to each other by using double-sided tapes or may be connected fixedly by using bolts.

In addition, the present invention further provides a satellite television receiving system, including a feed, a low noise block, and a satellite receiver, where the satellite television receiving system further includes the foregoing offset feed satellite television antenna, and the offset feed satellite television antenna is set behind the feed.

The feed, the low noise block and the satellite receiver are covered in the prior art, and are not described here any further.

Although the embodiments of the invention have been described with reference to accompanying drawings, the invention is not limited to the specific implementation manners. The specific implementation manners are merely illustrative rather than restrictive. As enlightened by the present invention, persons of ordinary skill in the art may derive many other implementation manners without departing from the ideas of the present invention and the protection scope of the claims of the present invention, which shall all fall within the protection scope of the present invention.

What is claimed is:

1. An offset feed satellite television antenna, comprising:

a metamaterial panel set in front of a feed, wherein the metamaterial panel comprises a core layer and a reflective panel set on a surface on a side of the core layer, the side being opposite to the feed, the core layer comprises at least one core layer sheet layer, the core layer sheet layer comprises a sheet-shaped substrate and a plurality of artificial microstructures or pore structures set on the substrate, wherein the core layer sheet layer is divided into a plurality of strip regions according to refractive index profile, refractive indexes at a same radius that uses a specific point as a circle center in the a plurality of strip regions are the same and the refractive index decreases gradually with increase of the radius in each strip region, and, among two adjacent strip regions, a minimum value of the refractive index of a strip region located at an inner side is less than a maximum value of the refractive index of a strip region located at an outer side, the feed is on a line that passes through the circle center and is vertical to the core layer sheet layer, wherein the circle center does not coincide with a center of the core layer sheet layer, wherein the core layer comprises a plurality of said core layer sheet layers that are parallel to each other;

wherein all strip regions of a core layer sheet layer closest to the reflective panel among the a plurality of core layer sheet layers have a same refractive index range, that is, refractive indexes of each strip region decrease from a maximum value $n_{max}$ to a minimum value $n_{min}$ continuously;

wherein refractive index profile of a core layer sheet layer closest to the reflective panel among the a plurality of core layer sheet layers satisfies the following formulas:

$$n(r)_m = n_{max} - \frac{\sqrt{r^2+s^2} - \sqrt{(M_L+seg_k)^2+s^2}}{d};$$

$$seg_k = \sqrt{(v_0+k\lambda)^2-s^2} - \sqrt{v_o^2-s^2};$$

$$k = \text{floor}\left\{\frac{\sqrt{\left(|r-M_L|+\sqrt{v_o^2-s^2}\right)^2+s^2} - v_0}{\lambda}\right\};$$

and $$v_o = \sqrt{M_L^2+s^2},$$

wherein, $n(r)_m$ represents a refractive index value at a radius of r on the core layer sheet layer, and m represents a serial number of the core layer sheet layer and the total number of the core layer sheet layers;

s is a vertical distance from the feed to a core layer sheet layer close to the feed; and d is thickness of the core layer;

wherein refractive index profile of other core layer sheet layers satisfies the following formula:

$$n(r)_j = n_{min} + \frac{j}{m}(n(r)_m - n_{min}),$$

wherein, j represents a serial number of the core layer sheet layer, the serial number of the core layer sheet layer closest to the reflective panel is m, the serial number decreases consecutively in a direction from the reflective panel to the feed, and the serial number of the core layer sheet layer close to the feed is 1.

2. The offset feed satellite television antenna according to claim 1, wherein the core layer sheet layer further comprises a filler layer that covers the artificial microstructures.

3. The offset feed satellite television antenna according to claim 1, wherein the core layer is formed of 7 core layer sheet layers, that is, m=7.

4. The offset feed satellite television antenna according to claim 1, wherein the circle center is set in a location that is $M_L$ away from a lower edge of the core layer sheet layer.

5. The offset feed satellite television antenna according to claim 4, wherein the lower edge is a straight line, and the $M_L$ represents a distance between the circle center and a midpoint of the lower edge.

6. The offset feed satellite television antenna according to claim 4, wherein the lower edge is a curve, and the $M_L$ represents a distance between the circle center and a vertex of the lower edge.

7. The offset feed satellite television antenna according to claim 2, wherein a plurality of artificial microstructures of each core layer sheet layer of the core layer have a same shape, a plurality of artificial microstructures at the same radius have same geometric dimensions, the geometric dimensions of the artificial microstructures decrease gradually with increase of the radius in each strip region, and, among two adjacent strip regions, a minimum value of the geometric dimensions of the artificial microstructure of a strip region located at an inner side is less than a maximum value of the geometric dimensions of the artificial microstructure of a strip region located at an outer side.

8. The offset feed satellite television antenna according to claim 1, wherein a plurality of artificial pore structures of each core layer sheet layer of the core layer have a same shape, the a plurality of artificial pore structures are filled with a medium whose refractive index is greater than that of the substrate, a plurality of artificial pore structures at a same radius in a circular region and an annular region have a same size, and, within the circular region and the annular region respectively, the size of the artificial pore structures decreases gradually with increase of the radius, the size of an artificial pore structure of a minimum size in the circular region is less than the size of an artificial pore structure of a maximum size in the annular region adjacent to the circular region, and, among two adjacent annular regions, the size of the artificial pore structure of the minimum size in an annular region located on an inner side is less than the size of the artificial pore structure of the maximum size in an annular region located on an outer side.

9. The offset feed satellite television antenna according to claim 1, wherein a plurality of artificial pore structures of each core layer sheet layer of the core layer have a same shape, the a plurality of artificial pore structures are filled with a medium whose refractive index is less than that of the substrate, a plurality of artificial pore structures at a same radius in a circular region and an annular region have a same size, and, within the circular region and the annular region respectively, the size of the artificial pore structures increases gradually with increase of the radius, the size of an artificial pore structure of a maximum size in the circular region is greater than the size of an artificial pore structure of a minimum size in the annular region adjacent to the circular region, and, among two adjacent annular regions, the size of the artificial pore structure of the maximum size in an annular region located on an inner side is greater than the size of the artificial pore structure of the minimum size in an annular region located on an outer side.

10. The offset feed satellite television antenna according to claim 1, further comprising a diverging component having an electromagnetic wave divergence function that is set between the feed and the metamaterial panel.

11. The offset feed satellite television antenna according to claim 10, wherein the diverging component is a concave lens.

12. The offset feed satellite television antenna according to claim 10, wherein the diverging component is a diverging metamaterial panel, and the diverging metamaterial panel comprises at least one diverging sheet layer, and refractive indexes of the diverging sheet layer are distributed in a circular shape using a center of the diverging sheet layer as a circle center, and, at the same radius, the refractive index is the same, and the refractive index decreases gradually with increase of the radius.

13. A satellite television receiving system, comprising:

a feed, a low noise block, and a satellite receiver;

wherein the satellite television receiving system further comprises an offset feed satellite television antenna, wherein the offset feed satellite television antenna is set in front of the feed and comprises a metamaterial panel that is set behind the feed, the side being opposite to the feed, wherein the metamaterial panel comprises a core layer and a reflective panel that is set on a surface on a side of the core layer, the core layer comprises at least one core layer sheet layer, the core layer sheet layer comprises a sheet-shaped substrate and a plurality of artificial microstructures or pore structures that are set on the substrate, the core layer sheet layer is divisible into a plurality of strip regions according to refractive index profile, refractive indexes at a same radius that uses a specific point as a circle center in the a plurality of strip regions are the same and the refractive index decreases gradually with increase of the radius in each strip region, and, among two adjacent strip regions, a minimum value of the refractive index of a strip region located at an inner side is less than a maximum value of the refractive index of a strip region located at an outer side, the feed is on a line that passes the circle center and is vertical to the core layer sheet layer, and wherein the circle center does not coincide with a center of the core layer sheet layer;

wherein the core layer comprises a plurality of said core layer sheet layers that are parallel to each other;

wherein all strip regions of a core layer sheet layer closest to the reflective panel among the a plurality of core layer sheet layers have a same refractive index range, that is, refractive indexes of each strip region decrease from a maximum value $n_{max}$ to a minimum value $n_{min}$ continuously;

wherein refractive index profile of a core layer sheet layer closest to the reflective panel among the a plurality of core layer sheet layers satisfies the following formulas:

$$n(r)_m = n_{max} - \frac{\sqrt{r^2+s^2} - \sqrt{(M_L + seg_k)^2 + s^2}}{d};$$

$$seg_k = \sqrt{(v_0 + k\lambda)^2 - s^2} - \sqrt{v_o^2 - s^2};$$

$$k = \text{floor}\left\{\frac{\sqrt{\left(|r - M_L| + \sqrt{v_o^2 - s^2}\right)^2 + s^2} - v_0}{\lambda}\right\};$$

and $$v_o = \sqrt{M_L^2 + s^2},$$

wherein $n(r)_m$ represents a refractive index value at a radius of r on the core layer sheet layer, and m represents a serial number of the core layer sheet layer and the total number of the core layer sheet layers;

s is a vertical distance from the feed to a core layer sheet layer close to the feed; and d is thickness of the core layer;

wherein refractive index profile of other core layer sheet layers satisfies the following formula:

$$n(r)_j = n_{min} + \frac{j}{m}(n(r)_m - n_{min}),$$

wherein, j represents a serial number of the core layer sheet layer, the serial number of the core layer sheet layer closest to the reflective panel is m, the serial number decreases consecutively in a direction from the reflective panel to the feed, and the serial number of the core layer sheet layer close to the feed is 1.

* * * * *